United States Patent [19]

Saito et al.

[11] Patent Number: 4,671,645

[45] Date of Patent: Jun. 9, 1987

[54] DRIVING MECHANISM FOR TURNING A PHOTOSENSITIVE DRUM IN AN ELECTROPHOTOGRAPHIC COPYING MACHINE

[75] Inventors: Masashi Saito, Kyoto; Tsutau Shimamura, Shiga; Kojiro Henmi, Shiga; Hiroki Kyushima, Shiga, all of Japan

[73] Assignee: Dainippon Screen Mgf. Co., Ltd., Kyoto, Japan

[21] Appl. No.: 854,921

[22] Filed: Apr. 23, 1986

[30] Foreign Application Priority Data

Apr. 27, 1985 [JP] Japan ..... 60-63778[U]

[51] Int. Cl.[4] ..... G03G 15/00

[52] U.S. Cl. ..... 355/3 R; 355/3 DR; 188/83; 188/380

[58] Field of Search ..... 355/3 DR, 3 R; 188/83, 188/267, 380; 74/409; 464/180

[56] References Cited

U.S. PATENT DOCUMENTS 1,153,636 9/1915 Longden ..... 188/83

1,236,392 8/1917 Barger ..... 188/83

4,148,578 4/1979 Bujese ..... 355/8

*Primary Examiner*—R. L. Moses

*Attorney, Agent, or Firm*—Lowe, Price, LeBlanc Becker & Shur

[57] ABSTRACT

The present invention relates to a driving mechanism for turning a photosensitive drum in an electrophotographic copying machine, which is provided with a brake loading means to brake the turning force of the drum, and is characterized in that the brake loading means comprises a brake loading device for a power transmitting means arranged between the drum and a motor and a brake loading device for the drum.

The former device applies a predetermined frictional braking force to the turning of at least one follower axis in the power transmitting means and eliminates adverse effects of backlashes existing between the motor and the follower axis with respect to the turning stability of the drum. The latter device eliminates adverse effects of backlashes existing between the follower axis and the drum as the same above.

3 Claims, 4 Drawing Figures

DRIVING MECHANISM FOR TURNING A PHOTOSENSITIVE DRUM IN AN ELECTROPHOTOGRAPHIC COPYING MACHINE

BACKGROUND OF THE INVENTION

1. Field of the Invention

The present invention relates to a driving mechanism for turning a photosensitive drum in an electrophotographic copying machine, which includes a brake loading means for braking the drum against a driving force for turning it.

2. prior Art

Generally, the electrophotographic copying machine produces an equivalent electrostatic latent image for an original image on a photosensitive material of the peripheral surface of the photosensitive drum by scanning the original image under exposure and then records a reproduced image on recording paper by making the latent image to be visible by a toner development and transfering the toner developed image to the paper.

Well, it is known in the art that it is very important to synchronize the scanning under exposure and the turning of the photosensitive drum, that is to synchronize the canning speed under exposure and the moving speed of the drum surface correspond1ng to a desired copying magnification.

However, since the driving mechanism for both scanning system and photosensitive drum system have power transmitting means generally composed of pulleys, belts, gears, etc. and also the forces of inertia of said both systems are different to each other, the synchronization therebetween becomes worse due to backlashes in the driving mechanisms.

Therefore, Japanese Utility Model Publication No. 31548 of 1980 discloses the driving mechanism of above mentioned type which is provided with a brake loading means for braking the turning of a photosensitive drum constantly by a predetermined frictional braking force. That is, by mounting the flange of the photosensitive drum rotationally to a fixed axis, fixing a spring retainer to the axis, then fitting a ring-shaped braking spring, which is axially deformable, loosely to the axis between the flange and the spring retainer and forcing this braking spring contact to the flange of the drum constantly under a predetermined pressure, it is intended for the brake loading means to apply the predetermined frictional braking force upon the turning of the drum and to synchronize the peripheral speed of the photosensitive drum (the moving speed of the drum surface) and the scanning speed under expouser.

However, since the brake loading means in the above described prior art is composed of the brake loading device only for the photosensitive drum, there exists a limitation for improving the synchronization.

For example, in FIG. 4, in case of producing an electrostatic image on the photosensitive drum 2 through the optical system 20 and transfering the toner developed image made visible by the toner development device 21 onto the recording paper 22 which is held in contact with the drum 2 by the action of the counter bias chager 23, as the feeding speed of the paper feeding system 26 is set a little slower than the moving speed of the drum surface to prevent the paper 22 from being slakened, the external force is applied to the drum in such a direction as making its turning speed slower. On the contrary, after the recording paper being removed from the photosensitive drum 2, the external force is applied to the drum in such a direction as making its turning speed faster. Therefore, as the adverse effect by the backlashes in the driving mechanism which connects the electric motor 3 to the photosensitive drum 2 is not eliminated by the above described brake loading means only for the drum, some distortions are generated in the part of the reproduced image correponding to the time when either the feeding or the removal of the recording paper is commenced, and consequently the production of the latent image and the transference of the former image onto the paper can not be done in parallel. In this connection, the flucture in the above mentioned speed of the drum in the prior art is around 0.2–0.3% of its standard speed at that time. But it is necessary to keep the flucture within the extent of 0.1% in order to attain a reproduced image of high grade quality. The bad influences by the former flucture value can not be eliminated in the prior driving mechanism.

Although the braking force by the brake loading means can be increased as the countermeasure to eliminate the above described defects, it adds substantially to the cost because of increasing the out put power of the turning motor according thereto, hence, it is not advantageous. Further, even though it can be thought out that the electrostatic latent image is to be produced at the first turn of the photosensitive drum thereon and then the toner development and the transference of the toner developed image are to be done at the second turn of the drum, it has such defects as the time required for one cycle becomes two times and an image longer than one circuit of the peripheral length of the drum becomes impossible to be reproduced.

OBJECTS AND SUMMARY OF THE INVENTION

The present invention is directed to solving the problems noted above, and has for its object to provide a driving mechanism for turning a photosensitive drum in an electrophotographic copying machine, which can synchronize the peripheral speed of a photosensitive drum and the scanning speed under expouser more strictly.

The means of the present invention for accomplishing the above purpose is a driving mechanism for turning a photosensitive drum in an electrophotographic copying machine, in which a brake loading means comprises a brake loading device for the drum, which applies a predetermined frictional braking force upon the turning of the drum, and a brake loading device for a power transmitting means, which applies a predetermined braking force upon the turning of at least one rotary follower axis in the power transmitting means.

Accordingly, as a predetermined frictional braking force is applied upon the turning of the rotary follower axis in the power transmitting means between the turning motor and the photosensitive drum by the brake loading device disposed therebetween, the adverse effect by the backlashes existing between the turning motor and the rotary follower axis is eliminated.

While, the adverse effect by the backlashes existing between the photosensitive drum and the rotary follower axis in is eliminated by a predetermined frictional braking force applied upon the turning of the drum by the brake loading device for the drum.

Consequently, even though an external force acts in either positive or negative direction with respect to the turning direction of the photosensitive drum thereupon at the commencement of the paper feeding or the removal of the copied paper on the drum, the bad influence by the backlashes in the driving mechanism can be eliminated substantially by applying a braking load in such manners as above described.

The foregoing and other objects and attendant advantages of the present invention will be readily appreciated as the same become better understood by reference to the following detailed description when considered by the accompaning drawings, wherein:

DESCRIPTION OF THE PREFERED EMBODIMENT

Figure 3:
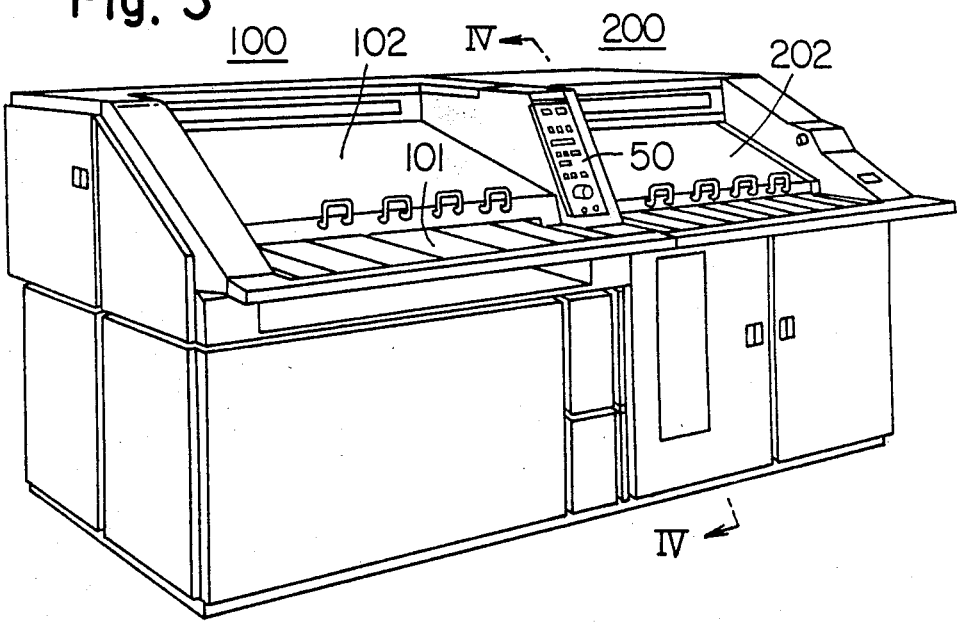
FIG. 3 is a perspective view of an electrophotographic copying machine according to the present invention.
Figure 4:
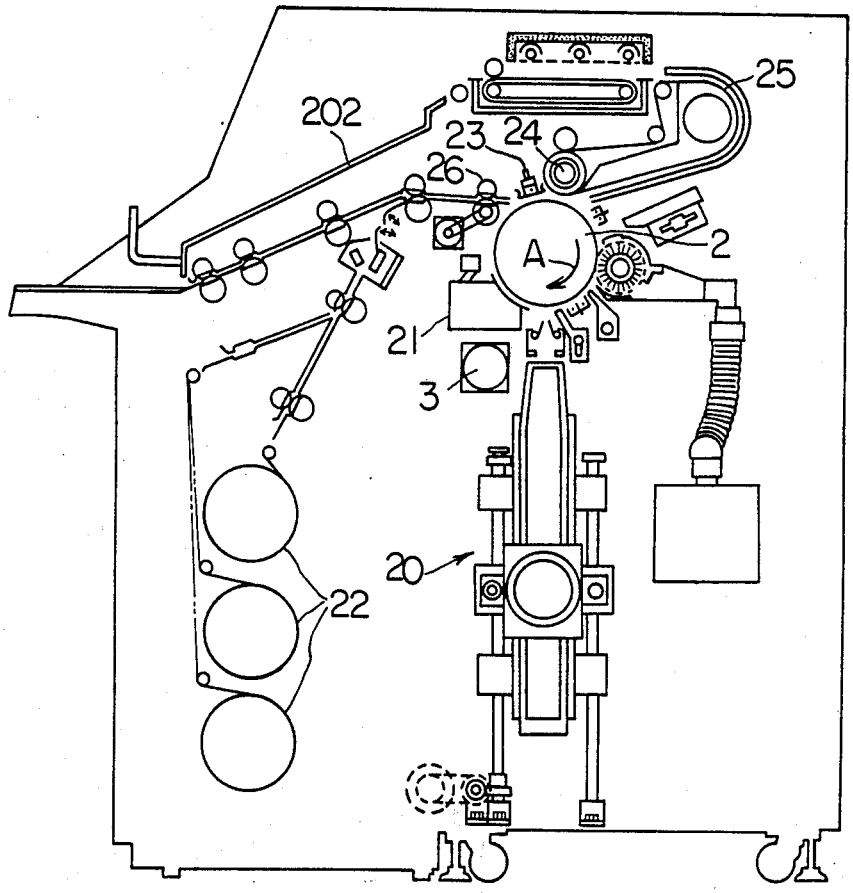
FIG. 4 is a sectional side view on line IV—IV in FIG. 3.

As shown in FIG. 3, a relatively large-sized electrophotographic copying machine comprises an operation panel 50 at the center of its front side, an original feeding and scanning equipment 100 at its left side and a reproduced image recording equipment 200 at its right side. In the original feeding and scanning equipment, when an original, of which image facing onto an original setter 101, is fed into the equipment, it is returned to an original receptacle 102 through its predetermined pathway being illuminated therein. While the original being fed through the pathway, the image of the original is exposed on a photosensitive drum 2 through an optical system 20 so that it may produce the corresponding electrostatic latent image thereon, which is made to be visible by means of the toner development device 21 in the recording equipment 200. Then the visible toner developed image is transferred on a sheet of recording paper 22, which is thereafter fed out to a copy receptacle 202 through its predetermined pathway 25 for the sheet.

Figure 1:
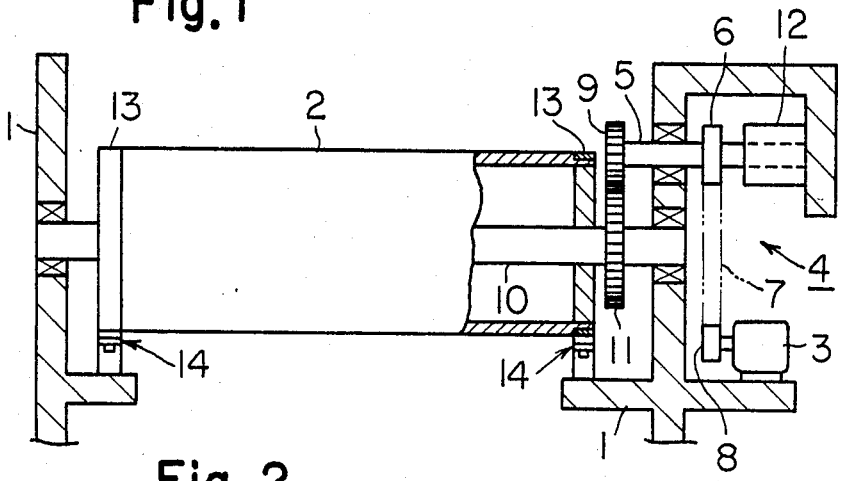
FIG. 1 is a schematic representation of the principal part of a preferred embodiment of a driving mechanism for turning a photosensitive drum in an electrophotographic copying machine according to the present invention.

In FIG. 1, the numeral 1 is the framework of the electrophotographic copying machine; 2 is the photosensitive drum; 3 is an electric motor, 4 is a power transmitting means which connects the electric motor 3 to the photosensitive drum 2 drivingly; 12 is a brake loading device for the power transmitting means; and 14 is a brake loading device for the drum.

In a driving mechanism for turning a photosensitive drum composed of the power transmitting device 4 having at least one rotary follower axis 5, the pulley 6 fixed onto the axis 5 is connected drivingly with the pulley 8 fixed onto the out put shaft of the electric motor 3 through the timing belt 7, and also the drive gear 9 fixed onto the rotary follower axis 5 is in mesh with the the follower gear 11 fixed onto the support shaft 10 of the photosensitive drum 2 so as for the turning force of the electric motor 3 to be transmitted to the photosensitive drum 2.

In the brake loading device 12 for the power transmitting means composed of an electromagnetic powder brake, the powder brake 12 applies a braking force onto the follower axis 5, which is controlled to a required intensity by regulating the electric current intensity to the brake 12.

Figure 2:
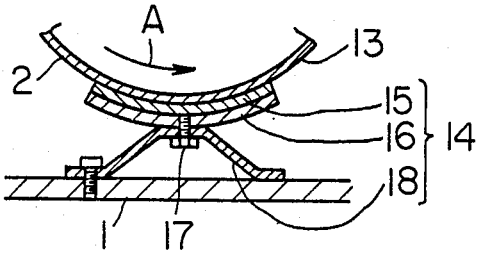
FIG. 2 is a sectional side elevation of a brake loading device for a photosensitive drum of the embodiment in FIG. 1.

The brake loading device 14 for the drum is arranged so as to contact slidingly with the annular abrassion resistance rings 13 fixed on the outer peripheral surfaces at the both edges of the photosensitive drum 2 and comprises a brake shoe 15 to contact with the rings 13, a fixing plate 16 of the brake shoe and a pushing leaf spring 18 combined therewith by a screw 17 to push the brake shoe 15 to the ring 13, as shown in FIG. 2. The pushing leaf spring 18 is fixed at its one part, while the other part being free, on the framework 1 according to the turning direction (shown by arrow A) of the drum so as to apply a predetermined frictional braking force to the photosensitive drum through the shoe 15.

In case of a pair of brake loading devices 14,14 being disposed at both edges of the photosensitive drum as being described above, the stability of turning speed of the drum is improved by applying the equal the braking forces to the both side ends of the drum comparing to the case of its one side disposition.

Besides, the driving mechanism of the present invention is applicable not only to the photosensitive drum of PPC (Plain Paper Copier) type with a photosensitive layer formed on the drum surface but to the photosensitive drum of CPC (Coated Paper Copier) type for the drum to be wound by such a recording paper as coated with sensitive material thereon in a electrophotographic copying machine, with equal effects.

From the foregoing description, the following effects will be evident to those skilled in the art. That is, as the influence of the external force generated when feeding a sheet of recording paper onto or removing it from a photosensitive drum, even though the external force acts in such directions as advancing or retarding the turning speed of the drum, can be eliminated by the driving mechanism of the present invention, the production of an electrostatic latent image on the drum and the transference of a toner developed image to the paper can be done in parallel, therefore a time required for the cycle of copying can be shortened and such a long continuous image as more than one circuit of the periferal length of the drum can be also reproduced.

Especially, the present invention can be applied more advantageously to a large-sized electrophotographic copying machine.

We claim:

1. A driving mechanism for turning a photosensitive drum in an electrophotographic copying machine including a photosensitive drum supported rotationally by a framework, a power transmitting means connecting a turning device to said drum drivingly and a brake loading means for braking the turning of said drum against turning force, characterized in that; said brake loading means comprises a brake loading device for said drum, said device applying a predetermined frictional braking force to the turning of said drum, and a brake loading device for said power transmitting means, said device applying a predetermined braking force to the turning of at least one turning follower axis in said power transmitting device.

2. A driving mechanism according to claim 1, wherein said brake loading device is an electromagnetic powder brake.

3. A driving mechanism according to claim 1, wherein said brake loading device comprises a brake shoe to contact with a annular abrassion resistance ring fixed on the outer peripheral surfaces at both edges of said drum, a fixing plate of said brake shoe and a pushing leaf spring combined with said fixing plate and fixed on said framework so as to push said brake shoe to said ring.

* * * * *